US005757398A

United States Patent [19]

Anderson

[11] Patent Number: 5,757,398

[45] Date of Patent: May 26, 1998

[54] LIQUID INK PRINTER INCLUDING A MAINTENANCE SYSTEM

[75] Inventor: David G. Anderson, Ontario, N.Y.

[73] Assignee: Xerox Corporation, Stamford, Conn.

[21] Appl. No.: 674,927

[22] Filed: Jul. 1, 1996

[51] Int. Cl.[6] ..... B41J 2/165

[52] U.S. Cl. ..... 347/32; 347/30

[58] Field of Search ..... 347/29, 30, 32, 347/33

[56] References Cited

U.S. PATENT DOCUMENTS

| | | | |
|---|---|---|---|
| 4,825,231 | 4/1989 | Nozaki | 347/32 |
| 4,853,717 | 8/1989 | Harmon et al. | 347/33 |
| 5,184,147 | 2/1993 | MacLane et al. | 347/30 |
| 5,206,666 | 4/1993 | Watanabe et al. | 346/140 R |
| 5,257,044 | 10/1993 | Carlotta et al. | 346/140 R |
| 5,343,773 | 9/1994 | Lehna | 74/89 |
| 5,367,326 | 11/1994 | Pond et al. | 346/140 R |
| 5,404,158 | 4/1995 | Carlotta et al. | 347/32 |
| 5,559,538 | 9/1996 | Nguyen et al. | 347/32 |
| 5,563,636 | 10/1996 | Glasset et al. | 347/30 |

*Primary Examiner*—Stuart N. Hecker
*Attorney, Agent, or Firm*—Daniel J. Krieger

[57] ABSTRACT

A liquid ink printer forming images on a recording medium including a liquid ink printhead movable between a printing position and a maintenance position and a maintenance arrangement, located at the maintenance position, including a driver, a first mechanism, and a second mechanism. The driver is coupled to the first mechanism and to the second mechanism and moves in a first direction to actuate the first mechanism and in a second direction to actuate the second mechanism. The driver includes a stepper motor having a single shaft coupled to the first mechanism and to the second mechanism through a unidirectional clutch. The first mechanism, such as a cam bank or rotary valve, is actuated by the stepper motor moving in a first direction, and the second mechanism, such as a vacuum pump is actuated by the stepper motor moving in a second direction.

20 Claims, 4 Drawing Sheets

LIQUID INK PRINTER INCLUDING A MAINTENANCE SYSTEM

FIELD OF THE INVENTION

The present invention relates generally to liquid ink recording apparatus and more particularly relates to a drive mechanism for a maintenance system therefore.

BACKGROUND OF THE INVENTION

Liquid ink printers of the type frequently referred to as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. Power pulses cause the droplets of ink to be expelled as required from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

It has been recognized that there is a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out.

There is also a need to prime a printhead before use, to insure that the printhead channels are completely filled with ink and contain no contaminants or air bubbles and also periodically to maintain proper functioning of the orifices.

Maintenance and/or priming stations for the printheads of various types of ink jet printers are described in, for example, U.S. Pat. No. 4,855,764, U.S. Pat. No. 4,853,717 and U.S. Pat. No. 4,746,938. Removal of gas from the ink reservoir of a printhead during printing is described in U.S. Pat. No. 4,679,059.

It has been found that to properly maintain an ink jet printhead two separate operations must be performed. In a first operation, a maintenance assembly is typically used to maintain proper condition or operation of the printhead nozzles by priming the nozzles, by wiping clean the nozzle face of the printhead, or by vacuuming the face of the printhead to remove any contaminants or ink which may have collected thereon. The second operation is to cap the printhead if the printhead nozzles will be exposed to air for extended periods of time to thereby prevent the ink contained in the nozzles from drying out. To prevent drying, a cap is brought into contact with a printhead to form a substantially airtight seal with the face of the printhead and around the nozzles.

Various methods and apparatus for maintaining the condition of ink jet printheads and for capping ink jet printheads are illustrated and described in the following disclosures which may be relevant to certain aspects of the present invention.

In U.S. Pat. No. 5,206,666 to Watanabe et al., an ink jet recording apparatus having a full-line type recording head rotatably supported between a recording position and a non-recording position is described. A cleaning member contacts the recording head during rotation of the recording head to remove deposited ink or foreign matter. In the non-recording position, the printhead is capped.

U.S. Pat. No. 5,257,044 to Carlotta et al. describes a cap actuation mechanism for use in a maintenance station for an ink jet printhead in a scanning type ink jet printer. A cap located on a cap carriage in an ink jet printer maintenance station provides the functions of printhead nozzle capping, priming, cleaning, refreshing, as well as waste ink management.

U.S. Pat. No. 5,367,326 to Pond et al. describes a page-width ink jet printer having a movable cleaning/priming station adapted for movement parallel to and along an array of printhead nozzles. The cleaning and priming station is slidingly moved along a ledge surface so that the cleaning and priming station is maintained a fixed distance from the face of the printhead.

SUMMARY OF THE INVENTION

In accordance with one aspect of the present invention, there is provided a liquid ink printer forming images on a recording medium, comprising a liquid ink printhead movable between a printing position and a maintenance position and a maintenance arrangement, located at the maintenance position, including a driver, a first mechanism, and a second mechanism. The driver is coupled to the first mechanism and to the second mechanism and moves in a first direction to actuate the first mechanism and moves in a second direction to actuate the second mechanism.

BRIEF DESCRIPTION THE DRAWINGS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
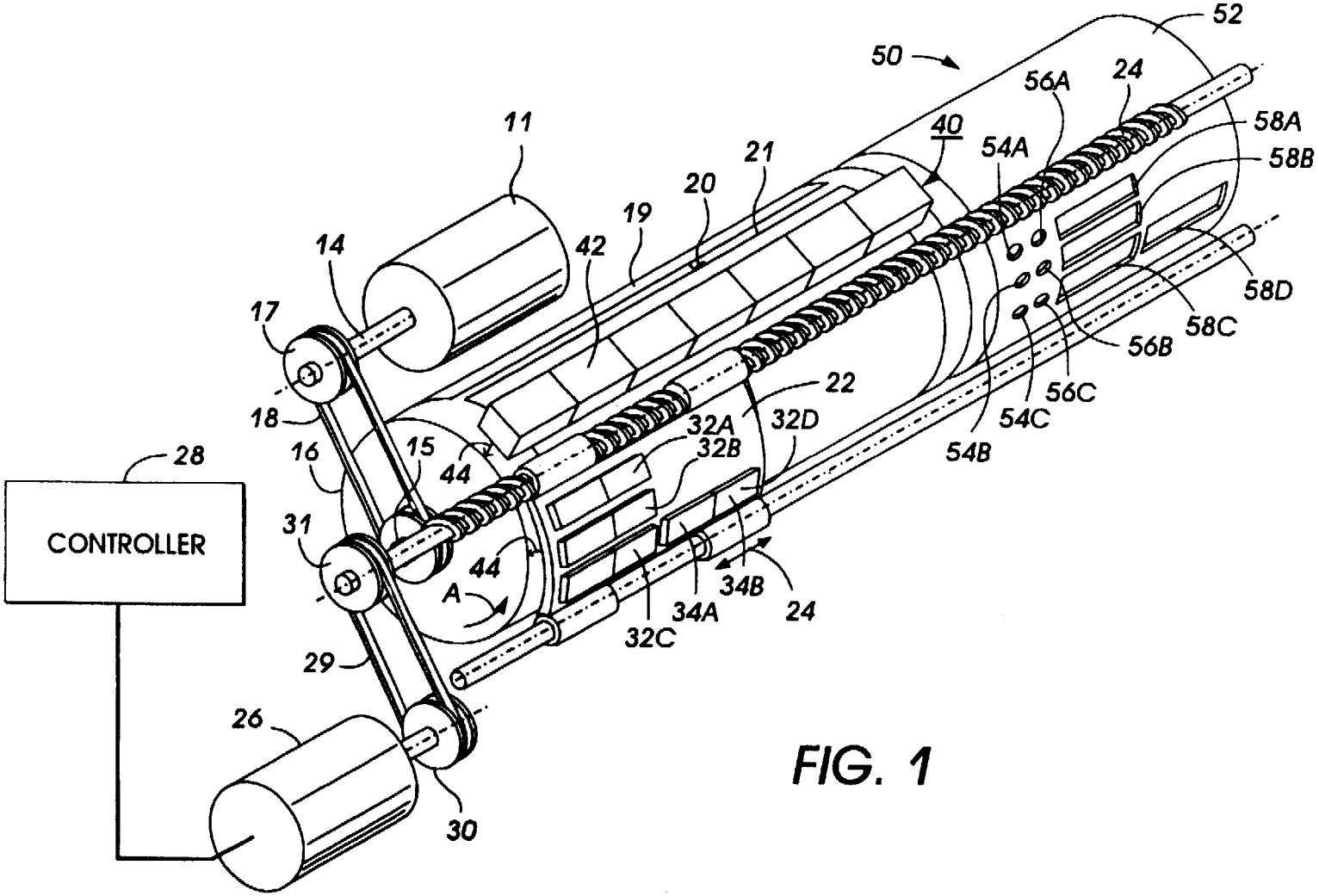
FIG. 1 illustrates a partial perspective view of a printer having a plurality of partial width array printheads and a pagewidth printbar for ink jet printing.

FIG. 1 illustrates the essential components of a printing apparatus, generally designated 10, in which the outside covers or case and associated supporting components of the printing apparatus are omitted for clarity. The printing apparatus 10 includes a motor 11 connected to a suitable power supply (not shown) and arranged with an output shaft 14 parallel to an axis 15 of a cylindrical drum 16 which is supported for rotation on bearings (not shown). A pulley 17 permits direct engagement of the output shaft 14, to a drive belt 18 for enabling the drum 16 to be continuously rotationally driven by the motor 11 in the direction of an arrow A at a predetermined rotational speed.

A recording medium 19, such as a sheet of paper or a transparency, is placed over an outer surface 20 of the drum 16, with a leading edge 21 attached to the surface 20 before printing to enable attachment of the sheet thereto either through the application of a vacuum through holes in the drum 16 (not shown) or through other means of holding such as electrostatic. As the drum 16 rotates, the sheet of paper 19 is moved past a printhead carriage 22 supported by a lead screw 24 arranged with the axis thereof parallel to the axis 15 of the drum 16 and supported by fixed bearings (not shown) which enable the carriage 22 to slidably translate axially. A carriage rail 23 provides further support for the carriage as the carriage moves in the direction of arrow 24 perpendicular to the moving direction of the sheet 21. A second motor 26, such as a stepper motor or other positioning mechanism, controlled by a controller 28, drives the lead screw with a second belt 29 connecting a clutch 30 and a clutch 31 attached to the lead screw 24 for movement thereof.

The printhead carriage 22 advances a first partial width array printbar 32A, a second partial width array printbar 32B, a third partial width array printbar 32C, and a fourth partial width array printbar 32D in the direction of arrow 24 for printing on the sheet 21. The first, second and third partial width array printbars 32A–C, respectively, each print one of the colors cyan, magenta or yellow for color printing. The fourth partial width array printbar 32D prints black when necessary, especially when printing graphics.

Each individual printbar 32A–32D include a first printhead die 34A and a second printhead die 34 butted together and mounted on a substrate (not shown) which can be made of a material such as graphite or metal. Each of the printhead dies 34A and 34B include several hundred or more nozzles which are fired sequentially in bank of nozzles. All of the printhead die are fired in parallel for one full printing of all the partial width arrays 32 on the carriage 22.

In addition to the partial width arrays 32, the printer 10 includes a full-width array or pagewidth printbar 40 supported by an appropriate support structure (not shown) above the drum 16 for printing on the recording medium 21. The pagewidth printbar 40 has a length sufficient to print across the entire width (or length) of the recording medium during a single pass of the recording medium beneath the printbar. The printbar 40 includes a plurality of printhead subunits 42 affixed to a supporting substrate (not shown) in an abutted fashion, as taught by U.S. Pat. No. 5,198,054 to Drake at al. and incorporated herein by reference. Alternatively, individual subunits 42 may be spaced from one another by a distance approximately equal to the length of a single subunit and bonded to opposing surfaces of the supporting substrate. In one embodiment, subunits 42 may be similar in construction to U.S. Pat. No. 4,774,530 to Hawkins, the relevant portions of which are incorporated herein by reference.

The forward facing edges of the subunits 34 and the subunits 42 contain ink jet printhead having droplet ejecting orifices or nozzles (not shown) which eject ink along a trajectory 44 substantially perpendicular to the surface of the recording medium 21. Printed wiring boards (not shown) contain circuitry required to interface and cause the individual heating elements (not shown) in the subunits to eject ink droplets from the nozzles. While not shown in FIG. 1, the printed wiring boards are connected to individual contacts contained on the subunits via a commonly known wire bonding technique. The data required to drive the individual heating elements of the printhead subunits is supplied from an external system by a standard printer interface, modified and/or buffered by a printer micro processor (not shown) within the printer and transferred to the printheads by ribbon cables (not shown) attached thereto.

The printing apparatus 10 also includes a maintenance system 50 located at one end of the drum 16. The maintenance system 50 includes assemblies which provide wet wiping of the nozzles of the printheads 32 and 34 as well as vacuuming of the same printheads for maintenance thereof. The wet wipe nozzles and vacuum nozzles shown in U.S. patent application Ser. No. 08/566,472, having the title Fluid Applicator for Maintenance of Liquid Ink Printers, and a filing date of Dec. 4, 1995, herein incorporated by reference, can be used. The wet wipe nozzles are located within a stationary drum housing 52 and extend through a plurality of apertures 54A, 54B and 54C when necessary to provide maintenance functions. When the printhead carriage moves to the maintenance position, the wet wipers apply a fluid to the ink jet nozzles such that any dried ink, viscous plugs or other debris is loosened on the front face of the ink jet printbars. Once the debris has been sufficiently loosened, a plurality of vacuum nozzles each extending through a plurality of vacuum nozzle apertures 56A–56C vacuum away any of the cleaning fluid as well as debris loosened thereby.

Once a printing operation has been completed and any cleaning of the printbars has been completed, if necessary, the carriage 22 is moved into position above a plurality of apertures 58A–58D. A plurality of capping members disposed within the housing 50, are moved into contact with the front faces of the printbars 32 and 34 through the apertures 58 to thereby cap the printbars to substantially prevent any ink which has been collected in the nozzles of the printbars from drying out. The cap members are also used in a priming operation to be described later with reference to FIG. 3.

Figure 2:
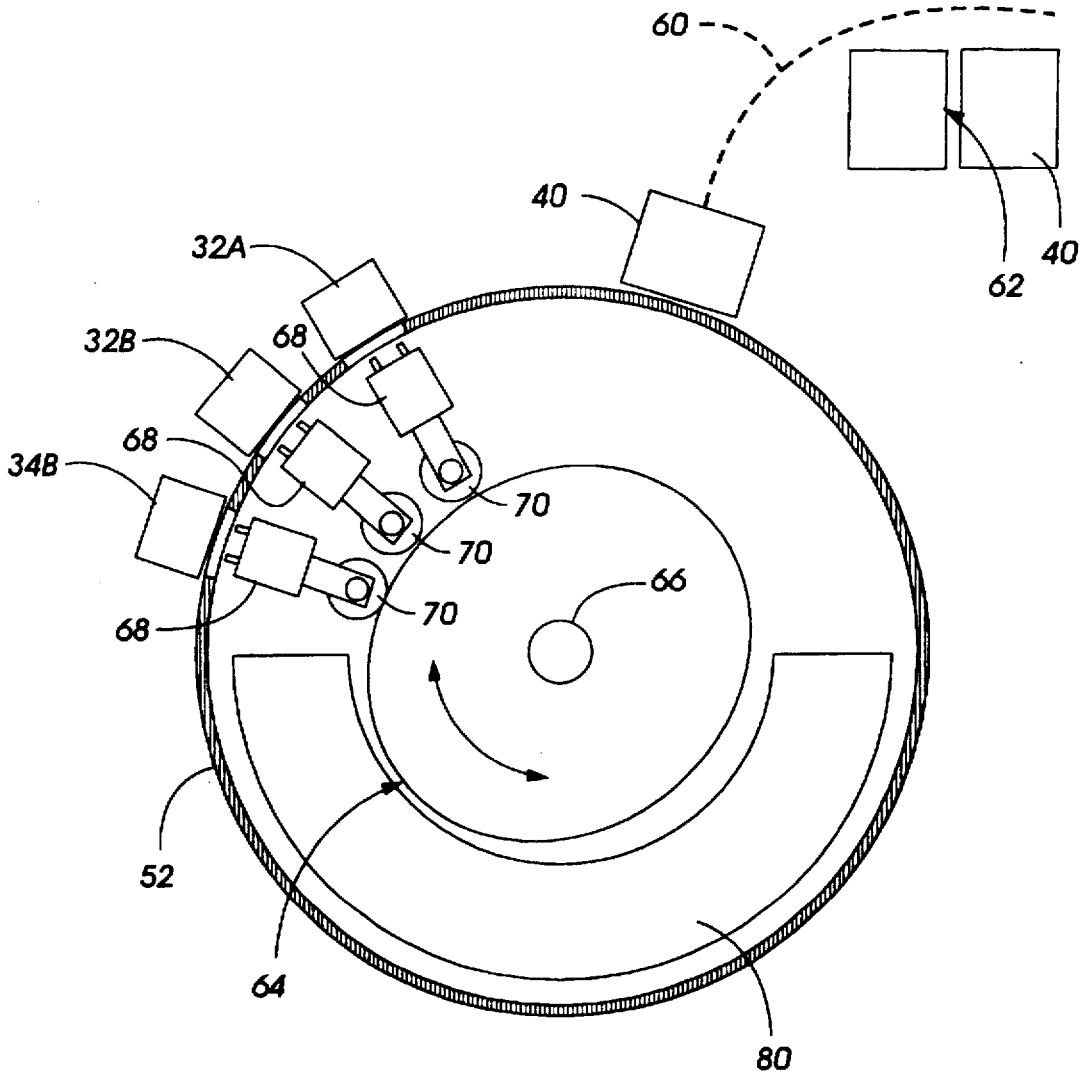
FIG. 2 illustrates an schematic elevational end view of a maintenance system including a cam bank and a plurality of capping members.

FIG. 2 illustrates an elevational view of the maintenance system 50 including the housing 52 and illustrating the printbars 32A, 32B, and 34B positioned above the corresponding apertures 58A, 58B and 58D. The pagewidth printbar 40 is also shown and can be moved in a direction of the dotted line 60 for a maintenance operation provided by a wet wipe/vacuum assembly 62 and capping member (not shown). The maintenance system 50 further includes a first mechanism or cam bank 64 which is rotated about an axis 66. The cam bank includes one or more cams eccentrically configured such that a plurality of capping members 68 are moved into contact with the printbars 32A, 32B, 32C and 32D during a maintenance operation. Rotation of the cam bank 64 around the axis 66 either places the capping members 68 into contact with the printheads or in a non-contacting position depending on the location of the contacting surface of the cam bank 64. Each of the capping members 68 includes a roller 70 which freely rotates in response to the rotation of the cam bank 64 during a maintenance operation thereby moving the capping members 68 into and out of position. A fourth capping member, not illustrated, would extend through the aperture 58C and would cap the printbar 32C.

Figure 3:
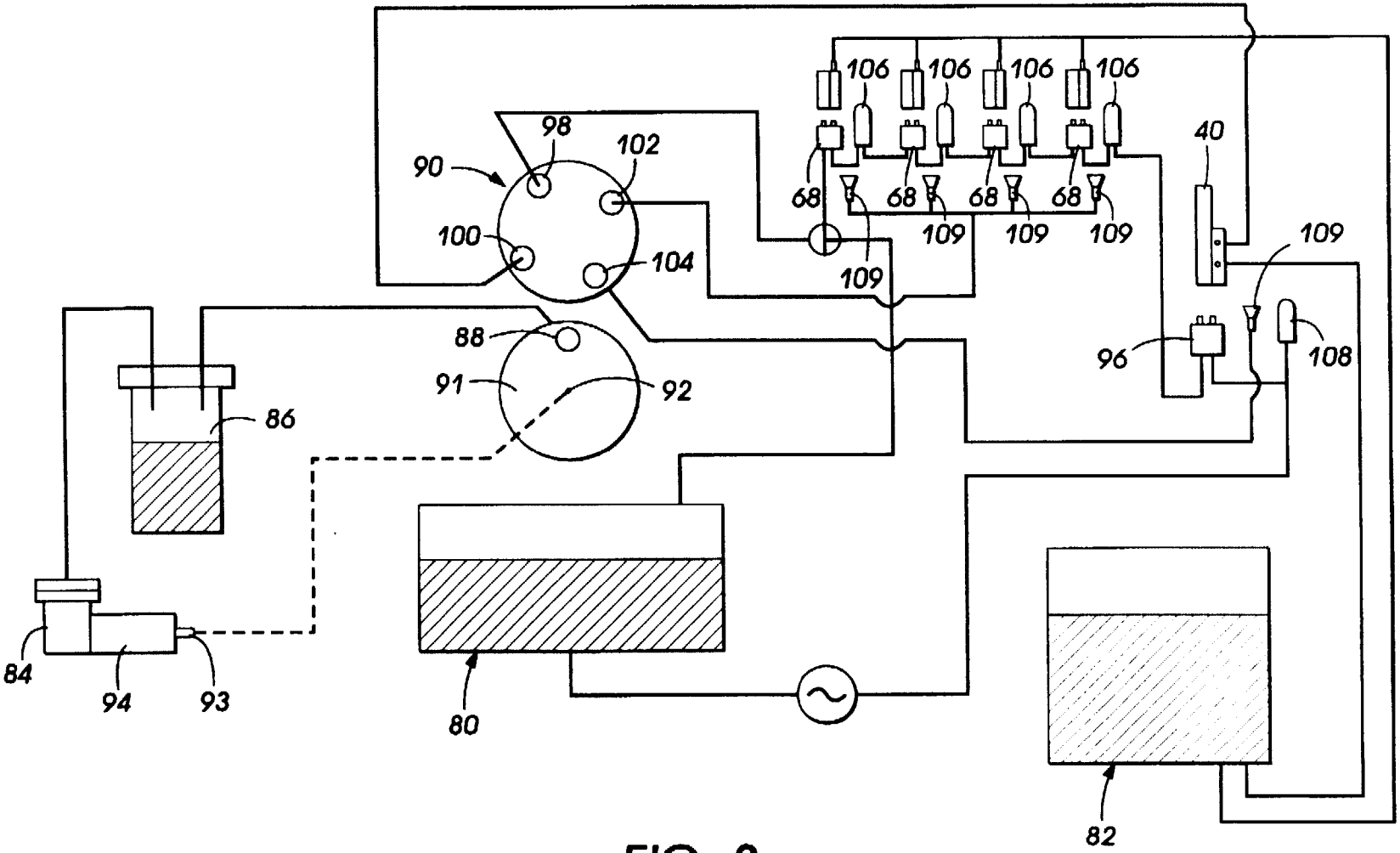
FIG. 3 illustrates a fluid/air schematic diagram of an ink reservoir and a maintenance fluid reservoir and connections thereof to the maintenance system of the present invention.

FIG. 3 illustrates a fluid/air schematic diagram of the maintenance system 50 showing the vacuum supply lines coupled to vacuum nozzles for both the full width array printbar 40 as well as the partial width array printbars 32 and 34 including a maintenance fluid reservoir 80, which can be located within the housing 52 of FIG. 2, and an ink reservoir 82 for supplying ink to not only the full width array printbar 40 but also to each of the partial width array printbars 32 and 34. A vacuum pump 84, such as a diaphragm pump or other vacuum generating devices, generates a vacuum through a waste sump 86 which is connected to an inlet 88 of a two piece multi-position rotary valve 90 which is used to select and apply either a vacuum for cleaning the faces of the printheads or for applying a vacuum used to prime the printheads during a priming operation which is typically necessary before the start of printing or oftentimes when the printheads lose prime. A first piece 91 of the rotary valve includes the aperture 88 and rotates about an axis 92 which is coupled to a single rotatable shaft 93 of a driver or stepper motor 94. The shaft 93 extends through the stepper motor and is coupled to the vacuum pump 84, as well, such that the stepper motor 94 drives not only the vacuum pump but the rotary valve and the cam bank, to be described later in more detail with reference to FIG. 4.

To begin printing, each of the printheads are primed by drawing ink from the ink reservoir 82 through the printheads and into one of the capping members 68 associated with the partial width printhead arrays 32 and 34 and through a capping member 96 used to prime as well as to cap the full width array printbar 40. During a priming operation for the partial width arrays 32 and 34, the aperture 88 of the rotary valve 90 is moved by the stepper motor 94 into alignment with an aperture 98. When the aperture 88 is aligned with the aperture 98 of the rotary valve 90, a vacuum is applied for priming the partial width array printheads. An aperture 100 of the rotary valve 90 provides for priming of the full width array 40. The capping members are also moved by the stepper motor 94 into contact with the printbars at the same time.

After printing has been completed, or at other times when a maintenance operation is necessary, the aperture 88 is aligned with either an aperture 102 which is used to apply a vacuum to the front face of the printhead nozzles after a wet wipe operation has been completed by wet wipe nozzles 103 or is used to apply a vacuum through an aperture 104 to the full width array printhead after a wet wipe operation has been performed thereon. Wet wipe nozzles for the partial width array printbars are illustrated as wet wipers 106 and a wet wiper for the full width array printbar is illustrated as wet wiper 108. Through the use of the multi-positioned rotary valve, the vacuum supplied by the vacuum pump 84 is used not only to provide for initial filling of the ink manifolds of each of the printbars but is also used to vacuum the nozzles during a maintenance operation through vacuum nozzles 109. In this operation, the capping members 68 would be moved out of the capping position and the wet wiper nozzles 106 and vacuum nozzles 109 would be moved into position, all by the stepper motor 94.

Figure 4:
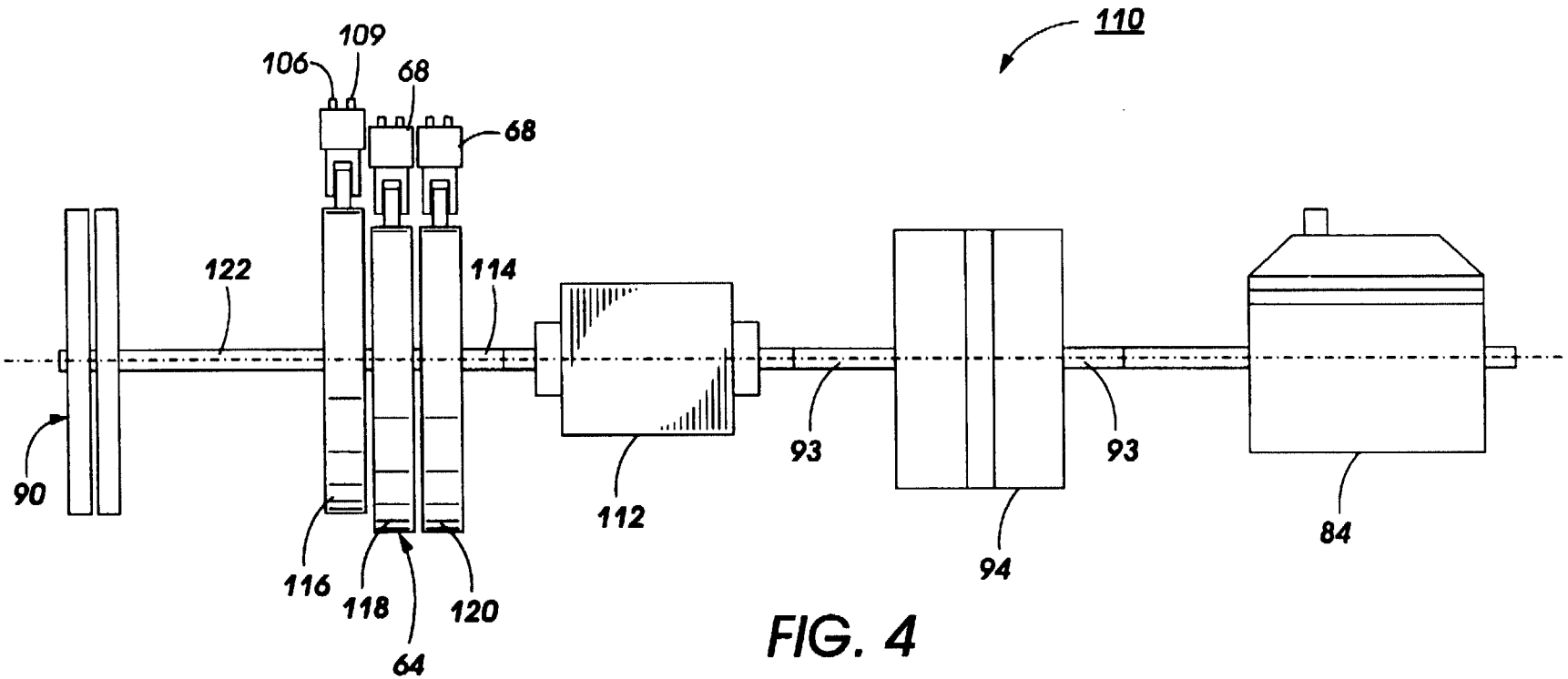
FIG. 4 illustrates a schematic view of a drive mechanism for the maintenance system including a stepper motor actuating a cam bank and a vacuum pump.

FIG. 4 illustrates a drive mechanism 110 of the present invention including the driver 94, or electromover, which is coupled to the vacuum pump 84 through the shaft 93. In addition, the shaft 93 is also coupled to the cam bank 64 through a unidirectional clutch 112 as well as the rotary valve 90. By using the stepper motor 94, the positioning function for the cams of the cam bank 64 as well as the rotary valve 90 is accomplished in an open loop fashion requiring only a home sensor for the motor. By counting the appropriate number of steps for the stepper motor, the cams of the cam bank 64 and the valve 90 are correctly positioned.

The stepper motor 94 provides for a variable speed control of the vacuum pump 84 and allows for relatively high vacuum pressures for vacuum priming and relatively low vacuum pressures for manifold fill operations. Because the vacuum pump 84 generates different amounts of vacuum depending on the rotational velocity of the shaft 93, the stepper motor 94 provides for pressure profiles to be tailored to minimize fill times for manifolds of the ink tanks while avoiding ink turbulence and associated bubble formation. Since the vacuum pump 84 is a diaphragm vacuum pump, when the axle 93 rotates in a first direction, the pump 84 generates a vacuum, the amount of which is dependent on the speed of rotation of the shaft. At the same time, even though the axle 93 is rotating in the first direction, the unidirectional clutch 112 is configured such that an output shaft 114 connecting the stepper motor 94 to the cam bank 64 does not rotate. This feature prevents the wet wipers 106 and vacuum nozzles 109 from moving out of position. By rotation of the shaft 93 of the stepper motor 94 in a second direction, the capping members 68 associated with respective cams 118 and 120, are moved through the associated apertures 58 for capping and priming, if necessary. Rotational motion of the shaft in the second direction will also drive the pump 84, but in this direction the amount of vacuum generated is negligible since movement of the shaft through a partial rotation to position the cams does not provide sufficient rotational velocity to create any noticeable vacuum.

The cams 116, 118 and 120 are eccentrically shaped. The cams 118 and 120 have surfaces offset from a surface of cam 116 such that the wet wiper 106 and vacuum nozzle 109 are moved out of the way of the printbars 32 and 34 so that capping by the capping member 68 may be completed without interference.

The rotary valve 90 is coupled to the cam bank 64 through a shaft 122 and therefore rotates in the same direction and with the same amount of rotation as the rotation of the cam bank 64. The rotary valve 90 is attached to the shaft 122 such that the apertures thereof are properly aligned for providing the necessary function when either the capping member 68 or the wet wipe/vacuum members are positioned accordingly. The rotary valve 90 could also be located between the unidirectional clutch 112 and the cam bank 64 and can be located either inside or outside the housing 52.

As can be seen, the maintenance drive system 110 provides a multitude of functions with a single driver such as the stepper motor 94. The driver 94 is coupled to the cam bank 64 or first mechanism which is used to position not only the capping members but also the maintenance assemblies. In addition, the driver 94 is coupled to a second mechanism 84 or the diaphragm vacuum pump such that depending on the rotating direction of the shaft 93, either the first mechanism or the second mechanism can be controlled without affecting the operation of the other. Consequently, the present invention provides for not only correct location of mechanical members but also for a vacuum operation.

In recapitulation, there has been described a liquid ink printer including a maintenance system having a multi-purpose drive system utilizing a single driver. It is, therefore, apparent that there has been provided in accordance with the present invention, a multi-function drive system for providing maintenance to ink jet printers that full satisfies the aims and advantages hereinbefore set forth. While this invention has been described in conjunction with a specific embodiment thereof, it is evident that many alternatives, modifications and variations will be apparent to those skilled in the art. The present invention is not limited to drum type ink jet printers, however, but is equally applicable to ink jet printers including flat platens as well as ink jet printers including drive rollers. A flat platen including the apertures necessary for moving capping members, priming members, or vacuum members through apertures of the flat platen using the drive system of the present invention is within the scope of the invention. For instance, while the present invention includes a stepper motor using a rotating shaft, a mechanical linkage could convert the rotational motion of the shaft 93 into linear motion such that the capping members and maintenance members are moved appropriately through the apertures of the platen. Accordingly, it is intended to embrace all such alternatives, modifications and variations that fall within the spirit and broad scope of the appended claims.

What is claimed is:

1. A liquid ink printer forming images on a recording medium, comprising:

a liquid ink printhead movable between a printing position and a maintenance position; and a maintenance arrangement, located at the maintenance position, including a driver, a unidirectional clutch, a first mechanism, and a second mechanism, said driver coupled to said first mechanism through said unidirectional clutch and to said second mechanism, said driver moving in a first direction to actuate said first mechanism and moving in a second direction to actuate said second mechanism.

2. The liquid ink printer of claim 1, wherein said driver comprises a single member coupled to said first mechanism and to said second mechanism, being adapted to actuate one of either of said first mechanism or said second mechanism during movement thereof.

3. The liquid ink printer of claim 2, wherein said driver comprises an electromover.

4. The liquid ink printer of claim 3, wherein said first mechanism comprises a first cam.

5. The liquid ink printer of claim 4, wherein said second mechanism comprises a pump.

6. The liquid ink printer of claim 2, comprising a cap member, said cap member being adapted to cap said liquid ink printhead in the maintenance position in response to movement of said first mechanism.

7. The liquid ink printer of claim 6, comprising a cleaning member being adapted to clean said liquid ink printhead in response to movement of said first mechanism.

8. The liquid ink printer of claim 7, wherein said cleaning member comprises a vacuum applicator coupled to said second mechanism, applying a vacuum to said printhead.

9. The liquid ink printer of claim 1, comprising a rotatable drum, disposed adjacent the printing position, said rotatable drum moving the recording medium past said liquid ink printhead.

10. The liquid ink printer of claim 9, wherein said driver comprises a single member coupled to said first mechanism and to said second mechanism, adapted to move one of either of said first mechanism or said second mechanism during movement thereof.

11. The liquid ink printer of claim 10, wherein said driver comprises an electromover.

12. The liquid ink printer of claim 11, wherein said second mechanism comprises a pump.

13. The liquid ink printer of claim 12, wherein said first mechanism comprises a first cam.

14. The liquid ink printer of claim 1, wherein said driver comprises a single shaft coupled to said first mechanism though said unidirectional cam and to said second mechanism, said single shaft rotating in a first direction to move said first mechanism and said second mechanism and in a second direction to move only said second mechanism.

15. A liquid ink printer forming images on a recording medium, comprising:

a liquid ink printhead movable between a printing position and a maintenance position;

a maintenance arrangement, located at the maintenance position, including a driver, a first mechanism, and a second mechanism, said driver coupled to said first mechanism and to said second mechanism and including a single member coupled to said first mechanism and to said second mechanism, said driver being adapted to actuate one of either of said first mechanism or said second mechanism during movement thereof, said driver moving in a first direction to actuate said first mechanism and moving in a second direction to actuate said second mechanism;

a cap member, said cap member being adapted to cap said liquid ink printhead in the maintenance position in response to movement of said first mechanism; and a cleaning member being adapted to clean said liquid ink printhead in response to movement of said first mechanism, said cleaning member including a vacuum applicator coupled to said second mechanism, applying a vacuum to said printhead, wherein said cleaning member comprises a fluid applicator applying a fluid to said liquid ink printhead.

16. A liquid ink printer forming images on a recording medium, comprising:

a liquid ink printhead movable between a printing position and a maintenance position; and a maintenance arrangement, located at the maintenance position, including a driver, comprising an electromover, a first mechanism, comprising a first cam, and a second mechanism, comprising a pump, said driver coupled to said first mechanism and to said second mechanism, said driver including a single member coupled to said first mechanism and to said second mechanism, said single member being coupled to said first mechanism through a unidirectional clutch and being adapted to actuate one of either of said first mechanism or said second mechanism during movement thereof, said driver moving in a first direction to actuate said first mechanism and moving in a second direction to actuate said second mechanism, wherein said electromover comprises a stepper motor.

17. The liquid ink printer of claim 16, wherein said pump comprises a diaphragm vacuum pump.

18. The liquid ink printer of claim 17, wherein said first mechanism comprises a second cam, said first cam and said second cam being offset.

19. The liquid ink printer of claim 18, wherein said first mechanism comprises a valve.

20. The liquid ink printer of claim 19, wherein said valve comprises a rotary valve.

* * * * *